US012232616B2

(12) United States Patent
Thrush

(10) Patent No.: US 12,232,616 B2
(45) Date of Patent: Feb. 25, 2025

(54) WALL AND CEILING TRACK SYSTEM FOR MOUNTING DEVICES

(71) Applicant: THE PARALLAX GROUP INTERNATIONAL, LLC, Aliso Veijo, CA (US)

(72) Inventor: Bruce Thrush, Aliso Viejo, CA (US)

(73) Assignee: THE PARALLAX GROUP INTERNATIONAL, LLC, Aliso Viejo, CA (US)

( * ) Notice: Subject to any disclaimer, the term of this patent is extended or adjusted under 35 U.S.C. 154(b) by 0 days.

(21) Appl. No.: 17/293,393

(22) PCT Filed: Nov. 15, 2019

(86) PCT No.: PCT/US2019/061835

§ 371 (c)(1),
(2) Date: May 12, 2021

(87) PCT Pub. No.: WO2020/102743

PCT Pub. Date: May 22, 2020

(65) Prior Publication Data

US 2022/0000265 A1 Jan. 6, 2022

Related U.S. Application Data

(60) Provisional application No. 62/768,362, filed on Nov. 16, 2018.

(51) Int. Cl.
*A47B 96/14* (2006.01)
*A47B 57/40* (2006.01)
(Continued)

(52) U.S. Cl.
CPC ..... *A47B 96/1466* (2013.01); *A47B 57/406* (2013.01); *A47F 5/0838* (2013.01);
(Continued)

(58) Field of Classification Search
CPC .... A47F 5/0853; A47F 5/0838; A47F 5/0846; A47F 5/08; A47F 5/0869; A47B 96/1466;
(Continued)

(56) References Cited

U.S. PATENT DOCUMENTS

D165,937 S * 2/1952 Rosenbaum ..... D8/377
3,172,540 A 3/1965 Berge
(Continued)

FOREIGN PATENT DOCUMENTS

CA 2800112 A1 11/2011
CA 2764508 A1 7/2013
(Continued)

OTHER PUBLICATIONS

International Preliminary Report on Patentability, PCT/US2019/061835, May 18, 2021.

*Primary Examiner* — Devin K Barnett
(74) *Attorney, Agent, or Firm* — Heidi Eisenhut; LOZA & LOZA, LLP

(57) ABSTRACT

The presently claimed invention contemplates a track for mounting devices onto a structure with a support surface on a rear side of the track configured to be installed on a structure. The track further comprises a first rear-facing hook and a second rear-facing hook that bends toward the rear side of the track. The first and second rear-facing hooks are disposed on opposite ends of the support surface.

19 Claims, 15 Drawing Sheets

(51) Int. Cl.
*A47F 5/08* (2006.01)
*A47B 96/06* (2006.01)

(52) U.S. Cl.
CPC ..... *A47B 96/06* (2013.01); *A47B 96/068* (2013.01); *A47B 96/1458* (2013.01); *A47F 5/08* (2013.01)

(58) Field of Classification Search
CPC ... A47B 57/406; A47B 96/14; A47B 96/1408; A47B 19/1441; A47B 96/1458; A47B 96/1475; A47B 96/1483; A47B 96/06; A47B 96/063; A47B 96/067; A47B 9/068
USPC ..... 211/94.01, 162; D8/377
See application file for complete search history.

(56) References Cited

U.S. PATENT DOCUMENTS 3,565,381 A 2/1971 Oliver
3,733,755 A 5/1973 Butler
3,765,344 A * 10/1973 Ferdinand ..... A47F 5/103 108/108
4,014,520 A 3/1977 Walters
4,026,508 A 5/1977 Ziegler
4,165,852 A 8/1979 Chervenak
4,467,925 A * 8/1984 Ratzloff ..... B25H 3/04 211/103
4,731,960 A * 3/1988 Sease ..... B44C 7/022 160/392
4,781,608 A * 11/1988 Hillmann ..... B60M 1/34 439/212
5,135,194 A 8/1992 Laughon
5,259,519 A * 11/1993 Lieberman ..... A47F 5/0853 211/66
5,332,108 A * 7/1994 Blass ..... A47F 5/0846 211/90.02
5,346,077 A 9/1994 Randall
5,511,675 A * 4/1996 Frederick ..... A47B 63/00 211/162
5,868,263 A 2/1999 McAllister
5,944,294 A 8/1999 Baer
6,050,426 A * 4/2000 Leurdijk ..... A47B 96/067 211/57.1
6,109,461 A 8/2000 Kluge
6,116,435 A * 9/2000 Young ..... F16B 13/124 411/510
6,119,878 A * 9/2000 Zen ..... A47F 5/0846 211/57.1
6,378,828 B1 4/2002 Valiulis
6,431,373 B1 * 8/2002 Blick ..... B25H 3/003 206/378
6,435,357 B1 * 8/2002 Lee ..... A47F 5/0838 211/70.6
D470,689 S * 2/2003 High ..... D8/382
6,530,486 B1 * 3/2003 Batting ..... A47F 5/0823 211/57.1
6,659,295 B1 12/2003 De Land
D489,465 S * 5/2004 Allsopp ..... D25/119
D494,842 S * 8/2004 Perkins ..... D8/354
D504,526 S * 4/2005 Perkins ..... D25/138
D520,148 S * 5/2006 Kendall ..... D25/138
7,063,296 B2 6/2006 Williams
D543,094 S * 5/2007 Remmers ..... D8/377
7,228,977 B2 * 6/2007 Perkins ..... A47B 83/001 211/87.01
7,240,803 B2 7/2007 Stitchick
D549,562 S * 8/2007 Browne ..... D8/373
D549,563 S * 8/2007 Browne ..... D8/373
D549,993 S * 9/2007 Guiles ..... D25/119
D549,995 S * 9/2007 Guiles ..... D25/119
7,296,697 B2 11/2007 Costa
7,387,212 B2 6/2008 Costa
7,401,705 B2 * 7/2008 Craft ..... A47B 96/00 211/103
7,427,053 B2 * 9/2008 Nawrocki ..... A47F 5/0006 211/57.1
D585,267 S * 1/2009 Di Vinadio ..... D8/377
7,497,533 B2 3/2009 Remmers
7,540,244 B2 6/2009 Gregory
7,717,279 B2 * 5/2010 Lawson ..... A47B 96/14 211/94.01
7,753,217 B2 * 7/2010 Lawson ..... A47F 5/0853 211/94.01
7,806,279 B2 * 10/2010 Kubota ..... A47F 5/0846 211/94.01
7,900,781 B2 * 3/2011 Baine ..... A47F 5/0838 211/59.1
7,900,783 B2 * 3/2011 Fernandez ..... A47B 57/42 211/90.02
7,992,728 B2 8/2011 Burgess
8,033,404 B2 * 10/2011 Keller ..... A47F 5/0846 211/94.01
8,056,739 B2 * 11/2011 Hopkins ..... A47F 5/0846 52/36.5
8,061,537 B2 11/2011 Nilsson
8,087,521 B2 1/2012 Schwartzkopf
8,096,516 B2 * 1/2012 Shiao ..... B25H 3/04 248/298.1
8,146,754 B2 * 4/2012 Apgood, II ..... A47F 5/0846 211/94.01
8,146,755 B2 4/2012 Schwartzkopf
8,177,311 B2 * 5/2012 Apgood, II ..... A47F 5/0846 312/245
8,210,368 B2 7/2012 Schwartzkopf
D668,945 S * 10/2012 Fernandez ..... D8/377
8,662,322 B2 3/2014 Magnusson
8,978,902 B2 * 3/2015 Barkdoll ..... A47F 5/0846 211/94.01
D767,382 S * 9/2016 Libreiro ..... D8/382
9,527,206 B1 * 12/2016 Hsieh ..... B25H 3/04
9,763,515 B2 * 9/2017 Fratilla ..... A47B 96/1441
10,111,522 B2 10/2018 Erlandsson
10,159,339 B1 12/2018 Powell
D874,908 S * 2/2020 Yue ..... D8/377
10,589,416 B1 * 3/2020 Hsieh ..... B25H 3/04
10,603,785 B1 * 3/2020 Hsieh ..... B25H 3/003
D922,809 S * 6/2021 Parab ..... D6/675.5
11,089,885 B2 * 8/2021 Keller ..... A47F 5/0846
D935,058 S * 11/2021 Bilge ..... D25/119
D935,060 S * 11/2021 Bilge ..... D25/121
2003/0192845 A1 * 10/2003 Lawson ..... A47F 5/0846 211/94.01
2004/0124163 A1 7/2004 Perkins
2005/0109720 A1 5/2005 Marchetta
2005/0145147 A1 7/2005 Costa
2005/0145588 A1 7/2005 Stitchick
2005/0150436 A1 7/2005 Marchetta
2005/0150850 A1 7/2005 Stitchick
2005/0247653 A1 * 11/2005 Brooks ..... A47F 5/0846 211/94.01
2006/0067661 A1 3/2006 Pierzynski
2006/0186000 A1 8/2006 Gregory
2006/0231711 A1 * 10/2006 Shin ..... F16M 11/10 248/291.1
2007/0017886 A1 * 1/2007 Kao ..... B25H 3/04 211/94.01
2007/0108148 A1 5/2007 Stitchick
2007/0205172 A1 9/2007 Stitchick
2008/0006592 A1 * 1/2008 Brooks ..... A47F 5/0846 211/89.01
2009/0152944 A1 6/2009 Baine
2009/0166307 A1 7/2009 Baine
2009/0206214 A1 8/2009 David
2010/0213346 A1 * 8/2010 Chen ..... A47F 5/0006 248/693
2010/0219144 A1 * 9/2010 Salmon ..... A47F 5/0846 211/94.01
2010/0300999 A1 * 12/2010 Schwartzkopf ..... A47F 5/0838 211/104
2012/0091086 A1 * 4/2012 Gregory ..... A47B 96/067 211/86.01

(56) References Cited

U.S. PATENT DOCUMENTS

| | | | | |
|---|---|---|---|---|
| 2013/0125495 | A1* | 5/2013 | Thrush | F16M 13/02 52/588.1 |
| 2013/0334383 | A1 | 12/2013 | Begic | |
| 2018/0132611 | A1 | 5/2018 | Lu | |
| 2018/0135796 | A1 | 5/2018 | Lu | |
| 2018/0220811 | A1* | 8/2018 | Thrush | F16M 13/022 |
| 2021/0237638 | A1* | 8/2021 | Moore | B60P 7/0815 |

FOREIGN PATENT DOCUMENTS

| | | | |
|---|---|---|---|
| EP | 0723410 | B1 | 1/2003 |
| KR | 10-2013-0098652 | A | 9/2013 |

* cited by examiner

WALL AND CEILING TRACK SYSTEM FOR MOUNTING DEVICES

FIELD OF THE INVENTION

The field of the invention is wall mounting devices and accessories.

BACKGROUND

The background description includes information that may be useful in understanding the present invention. It is not an admission that any of the information provided herein is prior art or relevant to the presently claimed invention, or that any publication specifically or implicitly referenced is prior art.

Various wall mounting devices for handling and storing items on a wall are known. For example, U.S. Pat. No. 7,900,781 to Baine describes a rail having a protrusion including a first flange and a second flange. Baine further discloses an accessory mount having a top hook for engaging the first flange and a resilient bottom hook for engaging the second flange.

As another example, U.S. Patent Publication No. 2012/0091086 to Gregory describes a rail having a first flange along an upper edge and a second flange along a bottom edge. A rail cover can be slid or snapped onto the rail. An accessory can be mounted onto the rail. The accessory has a downwardly-facing hook that is placed over a top edge of the rail cover, and a latch that engages the rail cover.

As yet another example, U.S. Pat. No. 7,992,728 to Burgess describes a track having a base, and a bar coupled to, and spaced from, the base to form an I-beam having a longitudinal axis. Burgess further discloses that the base is configured for attachment to a horizontal mounting surface or a vertical mounting surface.

While various configurations for mounting devices are known in the art, there is still a need for improved mounting devices that provide greater flexibility, compatibility, and customization.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

SUMMARY OF THE INVENTION

The inventive subject matter provides apparatus, systems, and methods in which a wall mounting assembly includes a track for mounting devices onto a structure, such as a wall or ceiling. The rear side of the track has a support surface with a first rear-facing hook and a second rear-facing hook. The track is typically mounted on the wall or ceiling by affixing the support surface to the structure. Once mounted, one or more devices/accessories having attachment mechanisms can be removably coupled to the track by engaging one or more of the first and second rear-facing hooks.

In another aspect, the inventive subject matter comprises a vertical rail that has a coupling unit, a first wall, and a second wall, and various support units. The vertical rail can removably couple to a track that is mounted on a structure, such as the one described above. The vertical rail can removably couple to one or more devices/accessories using the support units to thereby mount the devices/accessories onto the structure. The vertical rail can also be used cooperatively with other vertical rails by (i) coupling a first vertical rail onto a second vertical rail to extend the height of the second vertical rail, or (ii) coupling first and second vertical rails onto different positions on a track to provide added support for accessories and/or other mounting devices (e.g., a bracket, a shelf system).

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Figure 1A:
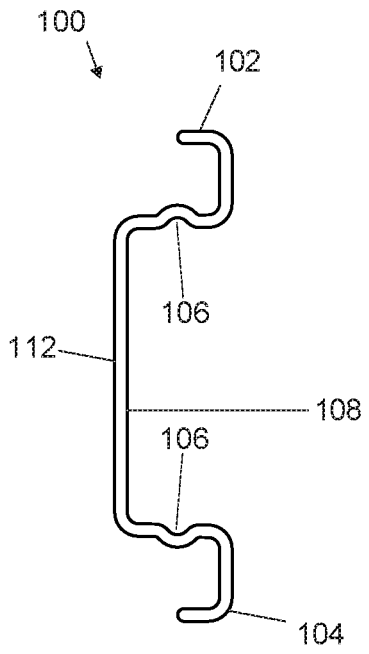
FIGS. 1A-1E depict various views of an embodiment of a track for mounting devices.
Figure 1B:
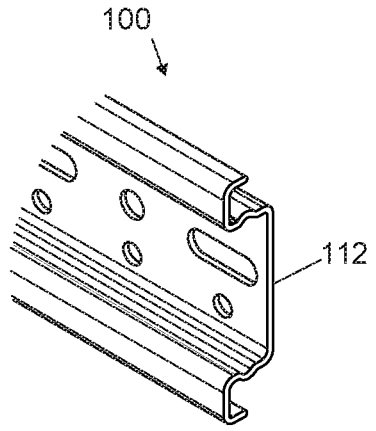
Figure 1C:
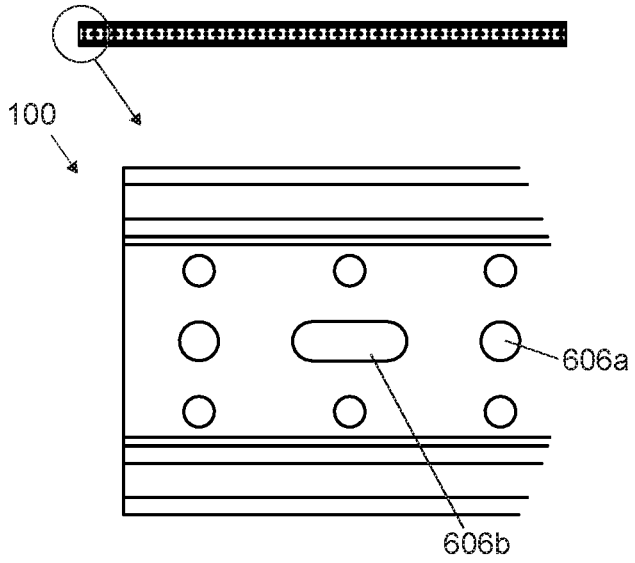
Figure 1D:
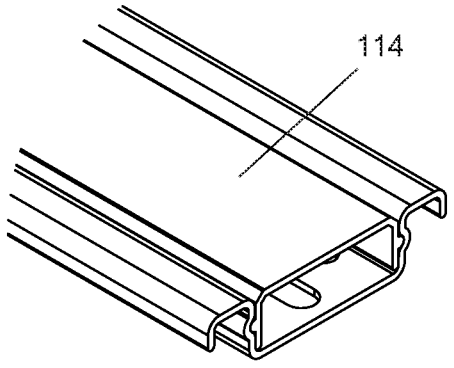

FIGS. 1A-1E depict various views of a track 100 for mounting devices. Track 100 comprises a support surface 112, a first rear-facing hook 102, and a second rear-facing hook 104 (see FIG. 1A). Support surface 112 is flat and is disposed at a rear side of track 100 (see FIG. 1B). Track 100 further comprises a cavity 108 that is defined by at least a portion of support surface 112, the first rear-facing hook 102 and the second rear-facing hook 104. It is contemplated that a cover can removably couple with track 100 to cover a portion of track 100. For example, a cover 114 as shown in FIG. 1D comprises protrusions that engage recesses or channels 106 within the cavity 108 of track 100.

Track 100 can be mounted onto a vertical and/or horizontal structure. For example, track 100 can be mounted onto a vertical wall or a ceiling. It is contemplated that track 100 is mounted onto the structure via support surface 112. In one embodiment, support surface 112 comprises one or more openings/apertures 606 adapted to receive one or more fasteners (e.g., a screw, a bolt, a nail, etc.). In another embodiment, support surface 112 can comprise multiple types of openings adapted to receive different types of fasteners (e.g., a first opening 606*a* for a screw and a second opening 606*b* for a bolt) (see FIG. 1C). For example, a first type of opening can be sized and dimensioned to receive ¼ inch screw diameters, and a second type of opening can be sized and dimensioned to receive ⅛ inch screw diameters.

Although fasteners are described above, it is contemplated that track 100 can be mounted onto a structure using other devices with or without fasteners (e.g., a screw, a bolt, a nail, etc.). For example, support surface 112 can be directly welded onto a metal structure to mount track 100 onto the structure. In another example, an adhesive can be applied to support surface 112 to mount track 100 onto a structure. Adhesives can include any non-metallic or partially metallic substance that binds surfaces together and resist separation. In some embodiments, an adhesive can be applied to support surface 112 followed by use of fasteners via openings in a support surface to create a mechanical bond between track 100 and the structure. For example, glue can be applied to a support surface and the glue can be allowed to seep through one or more openings that then receive fasteners to further assist in preventing separation of track 100 from the structure. In another example, glue can be applied to a support surface in a manner that it does not seep through opening on support surface 112, and then fasteners are driven through the openings and into a structure to mount track 100. It should be appreciated adhesive is applied to the side of support surface 112 that contacts the structure. Additionally, or alternatively, adhesive could be applied on the structure at a location where track 100 is to be mounted. In yet another example, the fastener could comprise magnetic couplings or mechanical engagements (e.g., male-female connectors, snap-fit connectors, hook and loop fasteners, etc.).

Figure 1E:
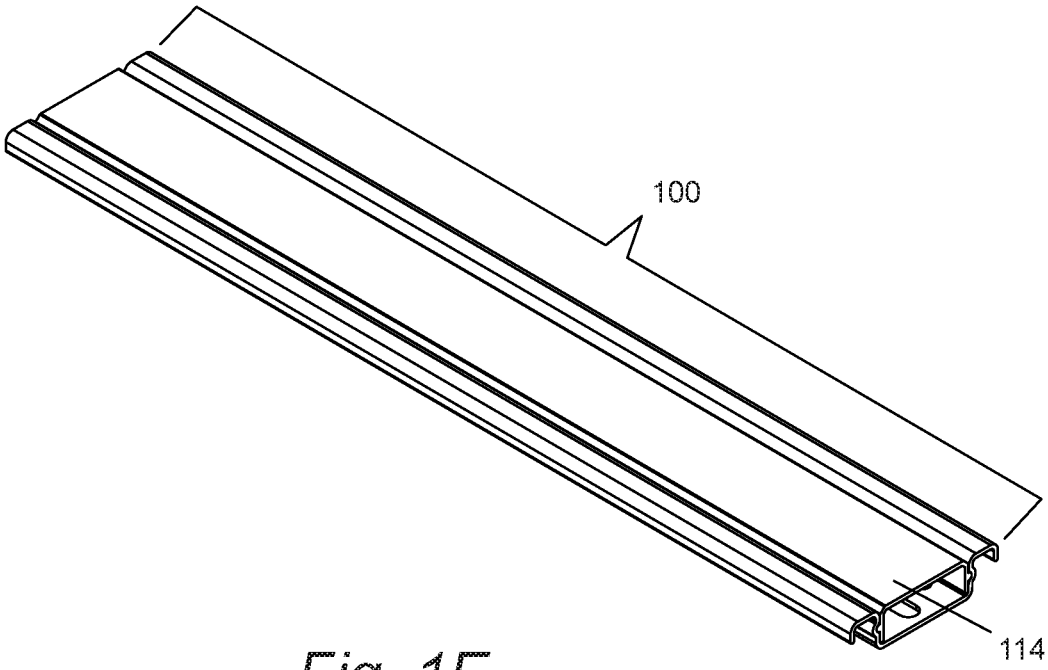

Cover 114 is configured to cover the openings in support surface 112 and any fasteners or devices that couple track 100 to the structure (see FIG. 1E). As shown in FIG. 1A, track 100 includes two recesses 106 or channels that are adapted to receive a corresponding protrusion on cover 114. It is contemplated that cover 114 can be pressed into a cavity 108 of track 100 defined by at least a portion of support surface 112, the first rear-facing hook 102 and the second rear-facing hook 104. Once cover 114 is pressed into the support structure with sufficient pressure, cover 114 can snap into place when the protrusions enter the recesses 106 of track 100. As shown in FIG. 1E, it is contemplated that cover 114 is the same length as track 100.

The first and second rear-facing hook are configured to couple with one or more track attachments, which will be discussed in further detail below. As shown in FIG. 1D, the first rear-facing hook 102 has a first portion that is substantially orthogonal relative to support surface 112. The first portion comprises a first recess 106 that is sized and dimensioned to receive a first cover protrusion. It is contemplated that other coupling members can be used (e.g., opening) to receive the first cover protrusion. Although cover 114 is disclosed as having a protrusion, it is contemplated that track 100 can comprise the protrusion and cover 114 can comprise a recess 106, opening or other coupling member that receives the protrusion. The first rear-facing hook 102 further comprises a second portion that runs substantially parallel to support surface 112. The first rear-facing hook 102 further comprises a third portion that runs substantially parallel to the first portion. It is contemplated that the first portion and second portion are substantially orthogonal and/or the second portion and third portion are substantially orthogonal. As used herein, "substantially orthogonal" means between 80°-100°. A first parallel portion is disposed between the first and third portions.

Similar to the first rear-facing hook 102, the second rear-facing hook 104 has a first portion that is substantially orthogonal relative to support surface 112. The first portion comprises a second recess 106 that is sized and dimensioned to receive a second cover protrusion. The second rear-facing hook 104 further comprises a second portion that runs substantially parallel to support surface 112. The second rear-facing hook 104 further comprises a third portion that runs substantially parallel to the first portion. It is contemplated that the first portion and second portion are substantially orthogonal and/or the second portion and third portion are substantially orthogonal. A second parallel portion is disposed between the first and third portions.

Figure 2A:
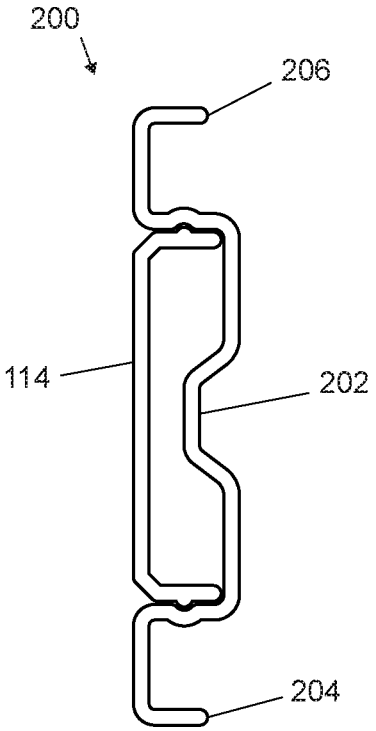
FIGS. 2A-2D depict various views of an alternative embodiment of a track for mounting devices.
Figure 2B:
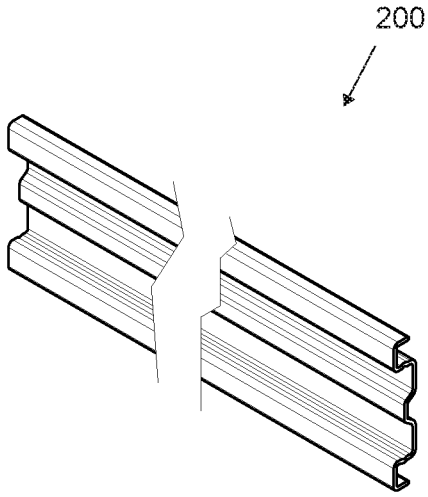
Figure 2C:
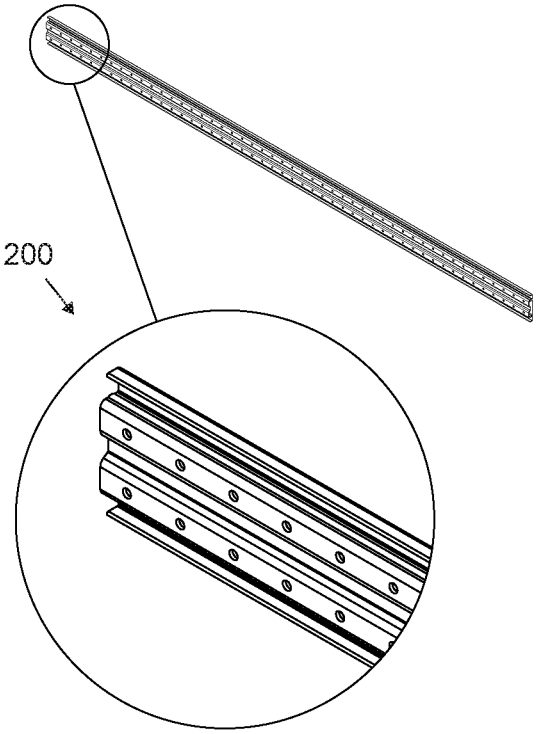
Figure 2D:
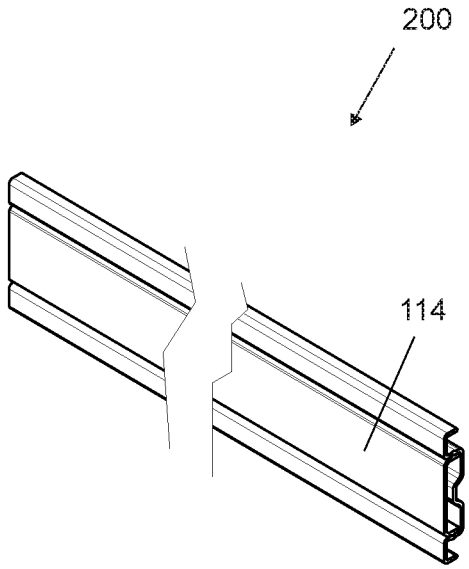

FIGS. 2A-2C depict various views of another embodiment of track 200 for mounting devices. Track 200 comprises a support surface 202, a first rear-facing hook 204, and a second rear-facing hook 206.

Support surface 202 partially defines a rear side of track 200. In the depicted embodiment, support surface 202 is configured to removably couple with a structure using one or more fasteners and one or more openings. The openings can comprise any shape or form including, for example, circular openings, ovular openings, and rectangular openings.

In one embodiment, support surface 202 comprises one or more openings adapted to receive one or more fastening devices. In another embodiment, support surface 202 can comprise multiple types of openings adapted to receive different types of fastening devices. In embodiments where support surface 202 comprises one or more openings, it is contemplated that the fastening devices can include screws, nails, and any other fastener known in the art.

As shown in FIG. 2A, support surface 202 is not flat. Support surface 202 includes a raised portion relative to two adjacent flat portions (i.e., the portions of the support structure that are closest to the wall when the support structure is attached). In this embodiment, the raised portion can include openings that accommodate one or more fasteners, and the flat portions can separately include openings that accommodate one or more fasteners of the same or different type.

In some embodiments, the raised portion can include multiple types of openings to accommodate different types of hardware fasteners. For example, the raised portion can comprise a first type of opening sized and dimensioned to receive ¼ inch screw diameters and a second type of opening sized and dimensioned to receive ⅛ inch screw diameters. The flat portions can similarly include different types of openings to accommodate different screw diameters.

Similar to the embodiment depicted in FIGS. 1A-1E, support surface 202 can be mounted onto a structure using other devices with or without fasteners (e.g., a screw, a bolt, a nail, etc.). For example, support surface 202 can be welded on to a metal structure to create a substantially permanent fixture. In another example, support surface 202 can use an adhesive to fix support surface 202 to a structure.

In yet another embodiment, support surface 202 and the structure can be coupled to a structure using a mixture of chemical adhesive agents and fasteners (e.g., a screw, a bolt, a nail, etc.). For example, support surface 202 can be coupled to a wall by applying glue between support surface 202 and the wall, and additionally fastening one or more screws from a first side of support surface 202 through to a second side of support surface 202 and finally into the wall.

Figure 3:
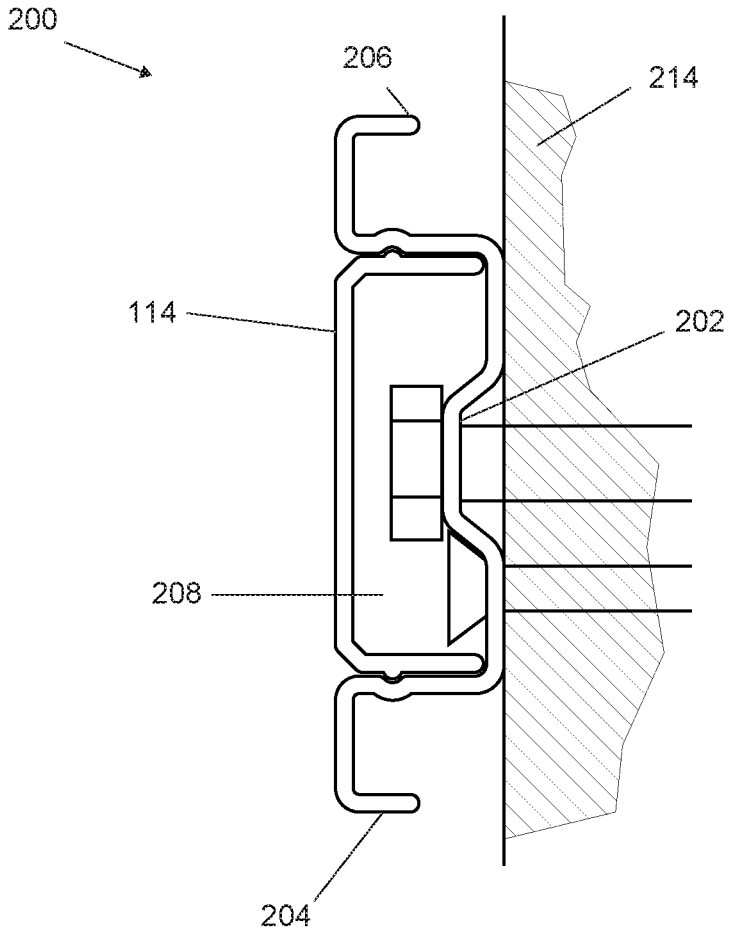
FIG. 3 depicts a cross-sectional view of the track in FIGS. 2A-2D mounted to a wall.

FIG. 3 depicts a cross-sectional view of track 200 shown in FIGS. 2A-2C. As shown, track 200 is capable of receiving different type of fasteners, such as wood screws on the flat portions and a lag bolt on the raised portion of support surface 202. In other embodiments, the hardware-based fastening devices can be of the same type. Furthermore, as shown in FIG. 3, track 200 comprises a cavity 208 adapted to receive a cover 114 via a snap-fit mechanism between cover protrusions and recesses on track 200. Cover 114 can alternatively be coupled to track 200 using a friction fit. The first and second rear-facing hooks 204 and 206 are configured to couple with corresponding structures on track attachments, which will be discussed in further detail below.

Track 200 can be installed on wall 214. Wall 214 can represent any solid surface that track 200 can be secured onto with fasteners or alternative attachment mechanisms as discussed above in FIG. 1.

FIGS. 4A-4D depict various perspective views of a vertical rail that mounts to track 100 and track 200. Vertical rail 400 comprises a coupling unit comprising a first hook and a second hook configured to removably couple with a track, first wall 412 coupled to coupling unit 402, second wall 414 coupled to coupling unit 402, support units coupled to first and second walls 412 and 414, and one or more slots 406 disposed between the first support unit and coupling unit 402 and between any two adjacent support units.

First wall 412 and second wall 414 are attached to coupling unit 402 and one or more support units. In one embodiment, first wall 412, second wall 414, and coupling unit 402 can be made of metal. In this embodiment, first and second walls 412 and 414 can each be welded to one or more coupling units 402 and support units 408 and 410. In other embodiments, first and second walls 412 and 414 can be coupled to the one or more coupling units and support units 408 and 410 using any one or more of adhesives, hardware based fasteners (e.g., a screw, a bolt, a nail, etc.), locking pin fasteners, and magnetic fasteners.

In other embodiments, first and second walls 412 and 414, the one or more coupling units 402, and support units 408 and 410 can be one continuous structure. For example, vertical rail 400 can be formed by a molding process or other manufacturing process that produces one continuous plastic structure or one continuous metal structure. In yet other embodiments, first and second walls 412 and 414, the one or more coupling units 402, and support units 408 and 410 can comprise a mixture of different materials. For example, first and second walls 412 and 414 can be made from a first metal or metal alloy, support units 408 and 410 can be made of one or more types of plastics, and coupling unit 402 can be made of a second metal or metal alloy. It is contemplated that the structures disclosed herein can comprise a variety of materials including, for example, metals, metal alloys, moldable polymeric materials, woods, glass, and composite materials.

It is contemplated that the bottom support unit can be thinner than the remaining support units to allow a second vertical rail to attach to a first vertical rail. For example, a first hook of a coupling unit 402 of a second vertical rail can be slid through the slot above a bottom support unit of a first vertical rail, and a second hook of coupling unit 402 of the second vertical rail can engage a bottom portion of the bottom support unit of the first vertical rail to thereby couple a second vertical rail onto a first vertical rail. It should be appreciated that the ability to couple two or more vertical rails allows additional accessories to be mounted along a vertical length.

It is also contemplated that coupling unit 402 comprises track couplers 416. Track couplers 416 allowing coupling unit 402 to removably couple with a horizontal track or one or more support units 408 and 410 of vertical rail 400.

Figure 4A:
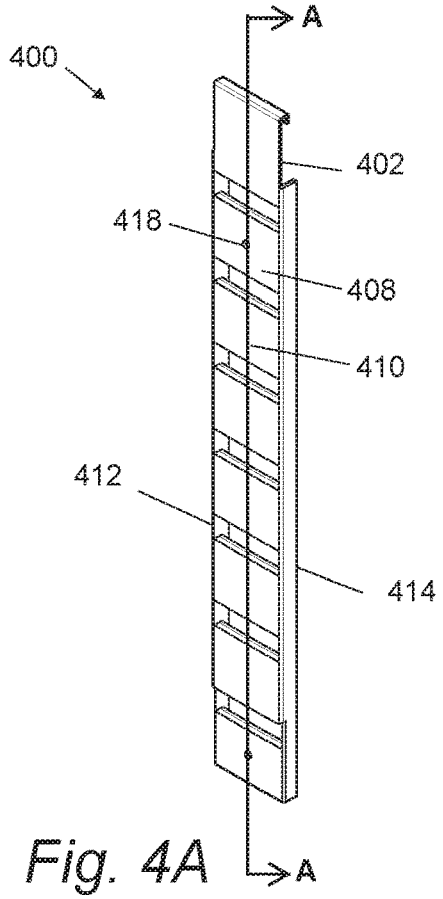
FIGS. 4A-4D depict various views of a vertical rail capable of attaching to the track in FIGS. 1A-1E and 2A-2D.
Figure 4B:
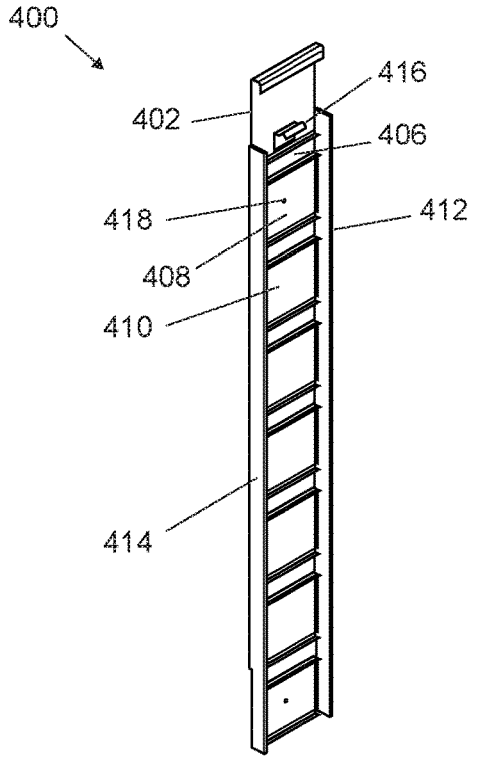
Figure 4C:
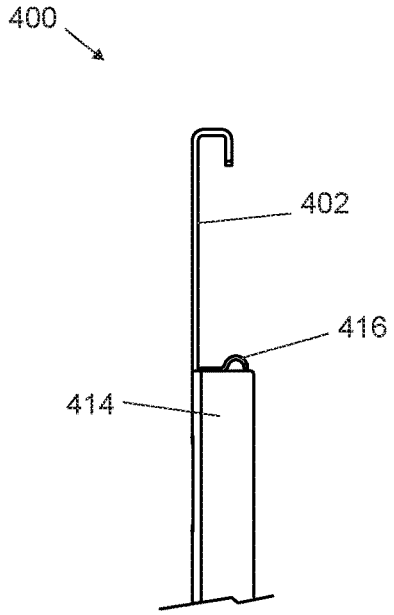
Figure 4D:
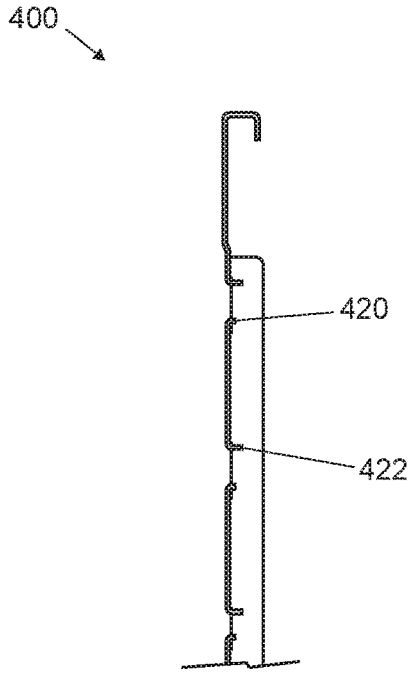

However, it is also contemplated that track couplers 416 do not exist in some embodiments, such as in FIG. 4D. In these embodiments, coupling unit 402 hangs off track 100 or track 200 and stays coupled to track by force of gravity.

In the depicted embodiment, anchor holes 418 are configured and distributed in any manner. For example, anchor holes 418 and their corresponding diameters can be each be substantially the same. In another example, anchor holes 418 and their corresponding diameters can be a mixture of different diameters.

FIG. 4D further depicts a cross sectional view of vertical rail 400 along line A-A (see FIG. 4A) showing a first lip 420 and a second lip 422. In the depicted embodiment, first lip 420 and second lip 422 extend towards the posterior surface of vertical rail 400. The depicted embodiment further shows first lip 420 being shorter than second lip 422.

In alternative embodiment, first lip 420 and second lip 422 can be in any length and direction. For example, first lip 420 can extend towards the anterior surface of vertical rail 400 and second lip 422 can extend towards a posterior surface of vertical rail 400. In another example, first lip 420 can extend in either direction and second lip 420 can extend in a posterior direction. In yet another example, first lip 420 and second lip 422 can extend at non-orthogonal angles relative to the anterior and/or posterior surfaces of vertical rail 400.

Figure 5A:
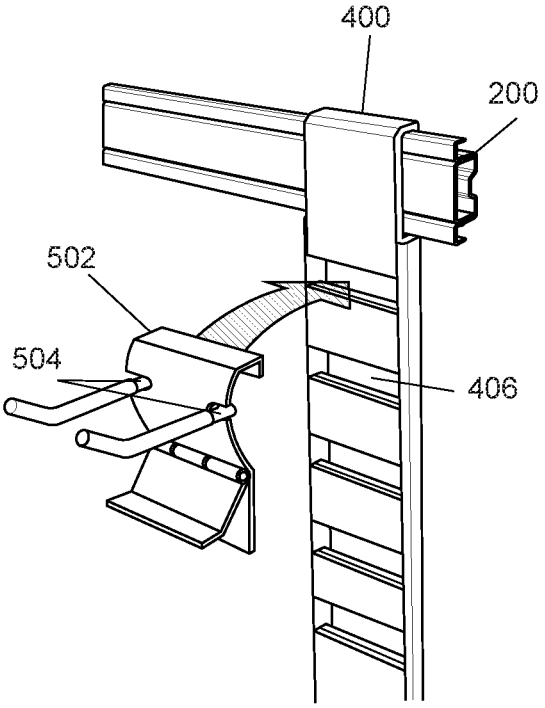
FIGS. 5A-5F depict various devices/accessories that can attach to the vertical rail in FIGS. 4A-4D.

FIGS. 5A-5F depict various devices/accessories that can be attached to vertical rail 400 and/or track 200. FIG. 5A depicts a utility hook that couples to slot 406 between a coupling unit and a first support unit of a vertical rail. It is contemplated, however, that utility hook 502 can couple to any slot along vertical rail 400, such as slots 406 formed by any two adjacent support units. Additionally, or alternatively, utility hook 502 can directly attach to track 200. Suitable utility hooks are described in U.S. Pat. Nos. 8,800,212 and 9,173,507, which are hereby incorporated by reference.

In one embodiment, utility hook 502 comprises two hooking members that are removably attached to two attachment mechanisms 504 on the anterior face of utility hook 502. The two hooking members can be attached to the two attachment mechanisms 504 using a magnetic coupling mechanism, a screw-based coupling mechanism, a snap-fit coupling mechanism, and/or a friction-fit coupling mechanism. It is contemplated that two attachment mechanisms 504 do not have to be the same type. For example, a first attachment mechanism of the two attachment mechanisms 504 can be magnetic, and a second attachment mechanism of the two attachment mechanisms 504 can be a screw-based coupling mechanism. In an alternative embodiment, the two attachment mechanisms 504 can be permanently fixed to the anterior face of utility hook 502.

In yet another embodiment, the two attachment mechanisms 504 can be configured to attach to alternative tools. In one example, the two attachment mechanisms 504 can be configured to attach to a reinforced hook made for supporting weights up to 100 pounds. In another example, the two attachment mechanisms 504 can be configured to attach to a longer retail hook configured to allow multiple inventory items to be stored and displayed in a retail environment.

Though the depicted embodiment in FIG. 5A shows a utility hook comprising two attachment mechanisms 504 and two hooking members, utility hook 502 can comprise any number of attachment mechanisms 504 and hooking members.

Figure 5B:
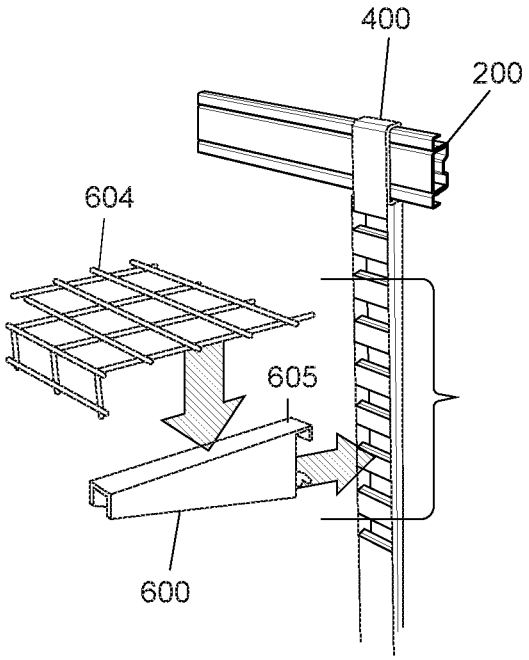

FIG. 5B depicts a bracket and shelf system whereby bracket 600 (discussed in further detail in the detailed description of FIG. 6) has hooks that are inserted into slots on vertical rail 400. It is contemplated that bracket and shelf system can couple to any slot, such as slots 406 formed by any two adjacent support units.

Bracket and shelf system further comprises a flat platform 604 on the top side of bracket 600, and a first and second cavity disposed on opposite lateral sides of bracket 600. Additionally, the flat platform 604 on the top side of bracket 600 can comprises openings to receive one or more fasteners. It is contemplated that a shelf can be coupled onto bracket 600 using the one or more fasteners. For example, a screw, a bolt, or a nail can be driven through the shelf and into the opening of bracket 600 to secure the shelf.

Figure 5C:
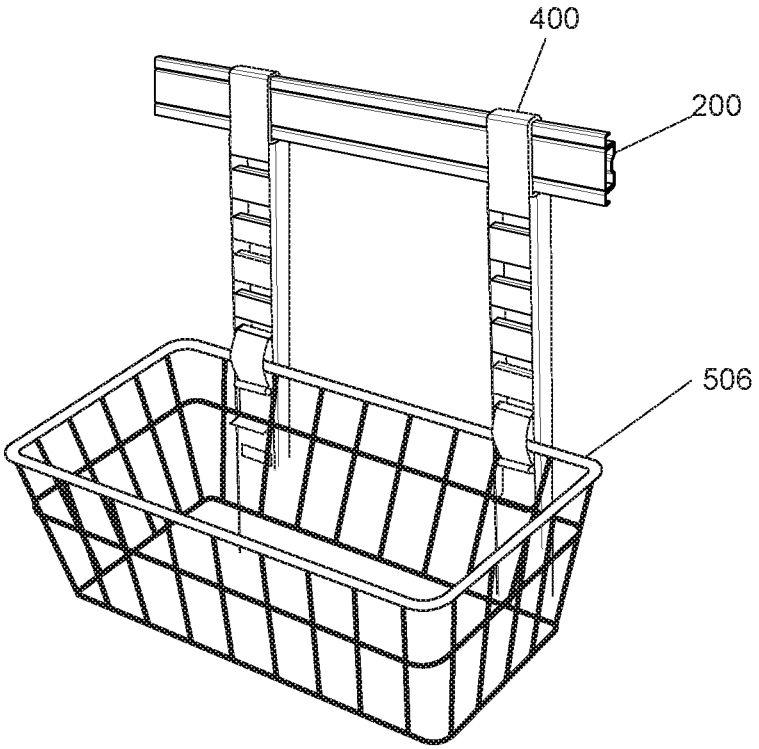

FIG. 5C depicts a basket assembly 506 that couples to slot 406 between a first and second support unit of a first vertical rail, and a second slot between a first and second support unit of a second vertical rail. It is contemplated, however, that basket assembly 508 is not limited to the depicted embodiment and can be coupled to only one slot between a first and second support unit.

Figure 5D:
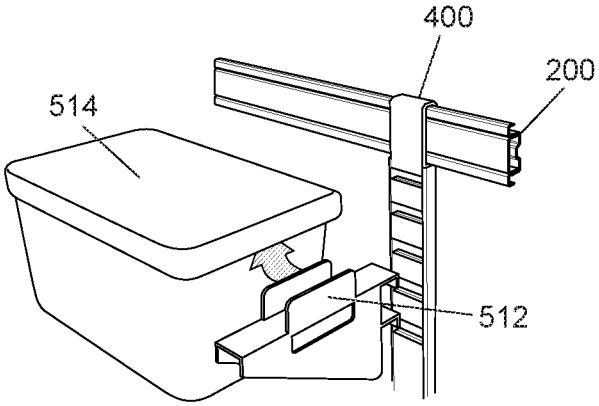

FIG. 5D depicts bracket and container 514, wherein bracket 512 has hooks that are inserted into a first and a second slot formed by support units of a vertical rail. As shown in FIG. 5D, a first support ridge on a flat platform on the top side of bracket 600 can be inserted into a corresponding cavity formed by a handle on container 514 to thereby attach container 514 onto bracket 600. It is contemplated that at least two brackets work cooperatively to engage two corresponding cavities on opposite sides of container 514 and thereby mount container 514. It is further contemplated that a second support ridge of bracket 600 shown in FIG. 5D can be inserted into a cavity formed by a handle of a different container. Thus, rows of containers can be mounted at various heights relative to the floor using a combination of tracks, vertical rails, and brackets. For example, three brackets, each having a pair of support ridges 512 can couple to two containers with the middle bracket engaging a cavity of a first container and a cavity of a second container, and the two other brackets each engaging an opposite cavity of the first or second container.

Figure 5E:
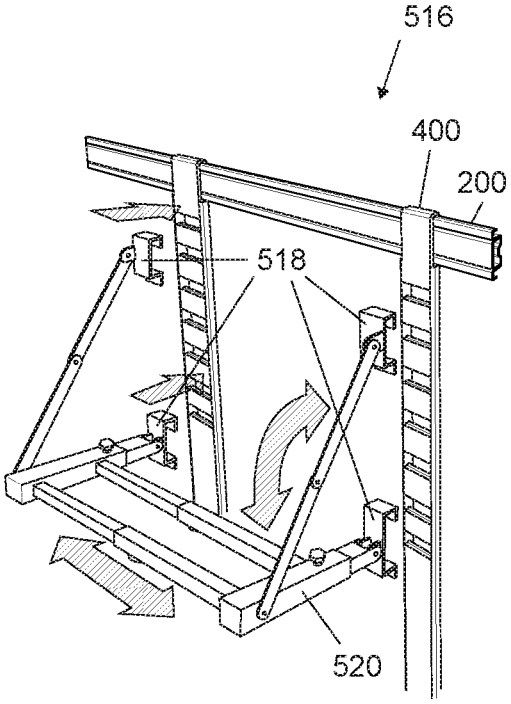

FIG. 5E depicts a tire rack system 516. Four connecting members 518 of the tire rack system each having hooks that are inserted into slots formed by the support units on a first and second vertical rail. In the depicted embodiment, first and second connecting members 518 of the tire rack system pair to the first vertical rail and third and fourth connecting members of the tire rack system pair to the second vertical rail. In preferred embodiments, the first and second connecting members are in a parallel arrangement relative to the third and fourth connecting members.

The connecting members attach to secure a platform formed by two support bars disposed between two platform arms 520 connected to a first set of connecting members. A second set of connecting members are coupled to two superior support arms which couple to a substantially anterior portion of the two platform arms 520, respectively. In one embodiment, the platform comprises two bars disposed between the two platform arms that can receive a tire.

Figure 5F:
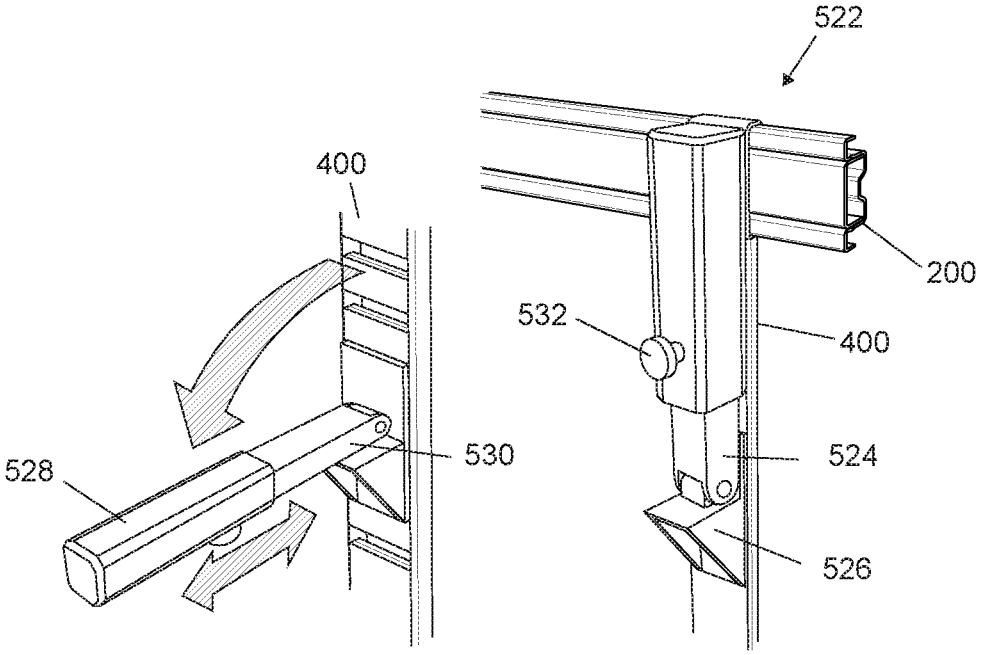

FIG. 5F depicts a lumber rack system 522 comprising a connecting member, a hinge attachment 524, a restriction mechanism 526, and a telescoping arm comprising first arm 528 and second arm 530, and restriction platform 532. The telescoping arm comprises first arm 528 and second arm 530 in a slidable relationship, such that first arm 528 substantially encapsulates second arm 530 when the telescoping arm is in a contracted configuration. In an extended configuration, an inner surface area of the first arm 528 and an outer surface area of the second arm partially overlap. In a preferred embodiment, the first arm 528 comprises a restricting mechanism to restrict the first and second arms 528 and 530 from sliding relative to each other. For example, the restriction mechanism 526 can comprise a screw that is coupled to a screw hole on first arm 528, which causes friction-based restriction of movement when engaged by exerting pressure on second arm 530.

The hinge attachment 524 allows first and second arms 528 and 530 to connect to the connecting member in a hinged configuration. In a preferred embodiment, the hinge attachment 524 attaches to second arm 530 using a pin lock mechanism. However, it is contemplated that any mechanism allowing a hinged relationship between the connecting member and second arm 530 can be used. The hinged configuration allows first and second arms 528 and 530 to move relative to the connecting member.

The restricting platform 532 limits rotation of first and second arms 528 and 530 from a vertical configuration to a horizontal configuration to a range of up to 90°. However, it is contemplated that the restricting platform 532 can be disposed at a different angle to allow greater or less degree of rotation for first and second arms 528 and 530.

Figure 6A:
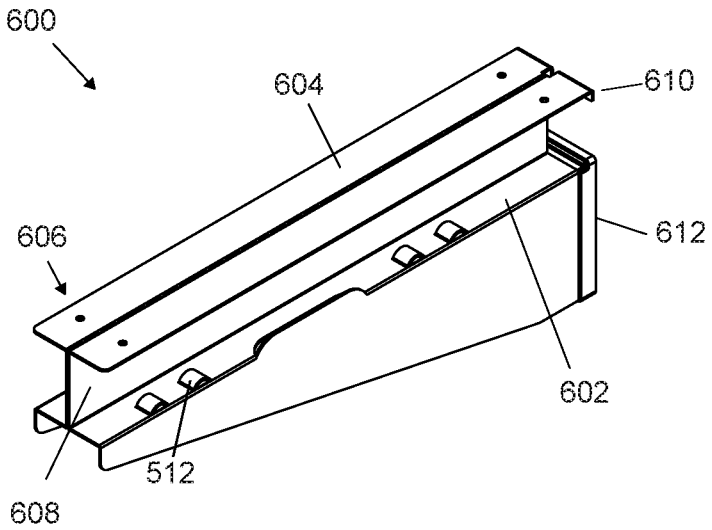
FIG. 6A-6C depict various views of a bracket that removably couples to the vertical rail in FIGS. 4A-4D.
Figure 6B:
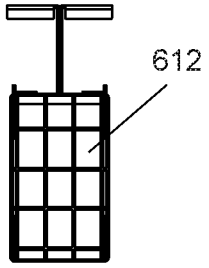
Figure 6C:
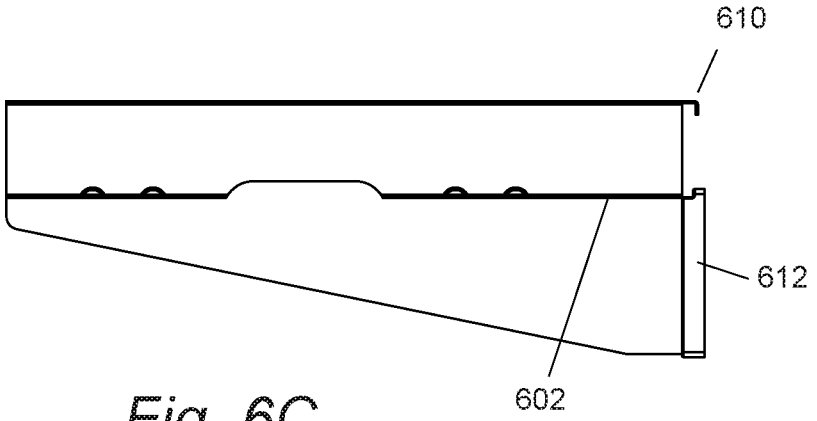

FIGS. 6A-6C depicts various views of a bracket that removably couples to vertical rail 400, track 100, or track 200 for mounting devices (see, e.g., FIG. 5B). Additionally, or alternatively, bracket 600 can removably couple with a slatwall mounting system and/or an overhead storage system. Suitable slatwall mounting systems are described in U.S. Pat. No. 8,746,472, which is hereby incorporated by reference. Suitable overhead storage systems are described in U.S. Pat. Nos. 8,657,130, 8,985,350, and 9,433,285, which are hereby incorporated by reference.

As shown in FIGS. 6A-6C, bracket 600 comprises a flat platform 604 at the top side of bracket 600, first and second cavities 608 disposed on lateral sides of bracket 600, a first and second accessory rails 602 that extend along the body of bracket 600, and top hook 610 for partial mounting of bracket 600 to a track and/or vertical rail. An adapter 612 can be coupled onto bracket 600 as shown in FIG. 6 to provide enhanced coupling with track 100 or track 200.

In some embodiments, the accessory rails 602 can comprise one or more protrusions to releasably engage with corresponding recesses on various accessories. For example, a container handle can comprise four recesses that mate with four corresponding protrusions in a first accessory rail 602 in order to restrict posterior-anterior movement (i.e., sliding) of the container.

It is contemplated that the flat platform 604 can comprises one or more attachment mechanisms 504. For example, the flat platform 604 can have one or more apertures 606 adapted to receive a fastener (e.g., a screw, a bolt, a nail, etc.) to fix a shelf to bracket 600. Additionally, or alternatively, the flat platform 604 can comprise one or more support ridges 512 adapted to engage slots of an accessory. For example, the support ridges 512 can releasably engage a shelf with corresponding slots to prevent substantial movement of the shelf relative to bracket 600.

Figure 6D:
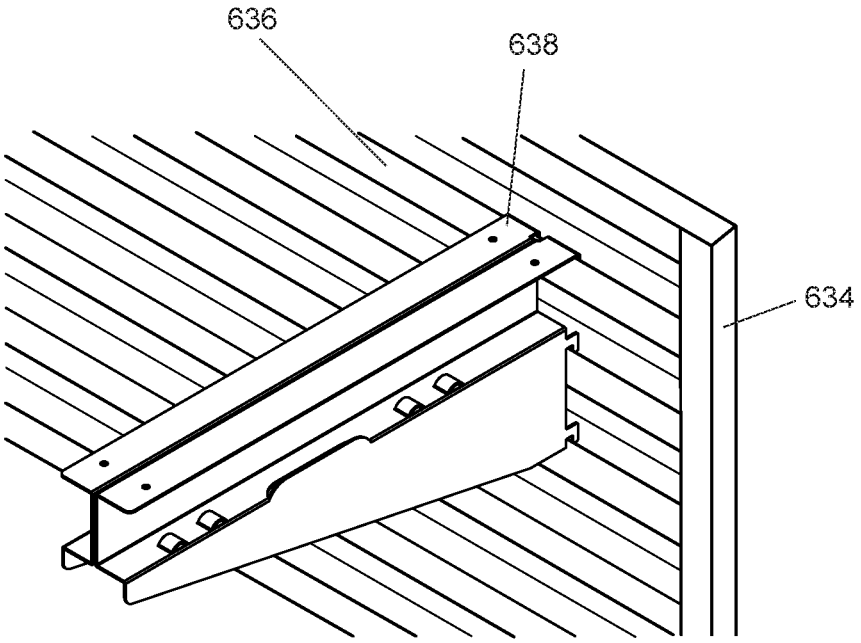
FIG. 6D depicts a bracket attached to a slatwall.

FIG. 6D depicts a slatwall 634 configured to removably couple with any one or more accessories 638, such as the embodiments depicted and described in FIGS. 5A-5F. It is contemplated that slatwall 634 comprises alternative rows of cavities 636 and support surfaces 638. It is contemplated that cavities 636 can be shaped in any manner to receive and secure any one or more accessories described above. It is further contemplated that cavities 636 can be through-holes that extend through both an anterior surface and posterior surface of slatwall 634.

In some embodiments, slatwall 634 has one or more anchor holes, such as the anchor holes 418. As with anchor holes 418, slatwall 634 can have any combination of anchor holes.

Figure 7A:
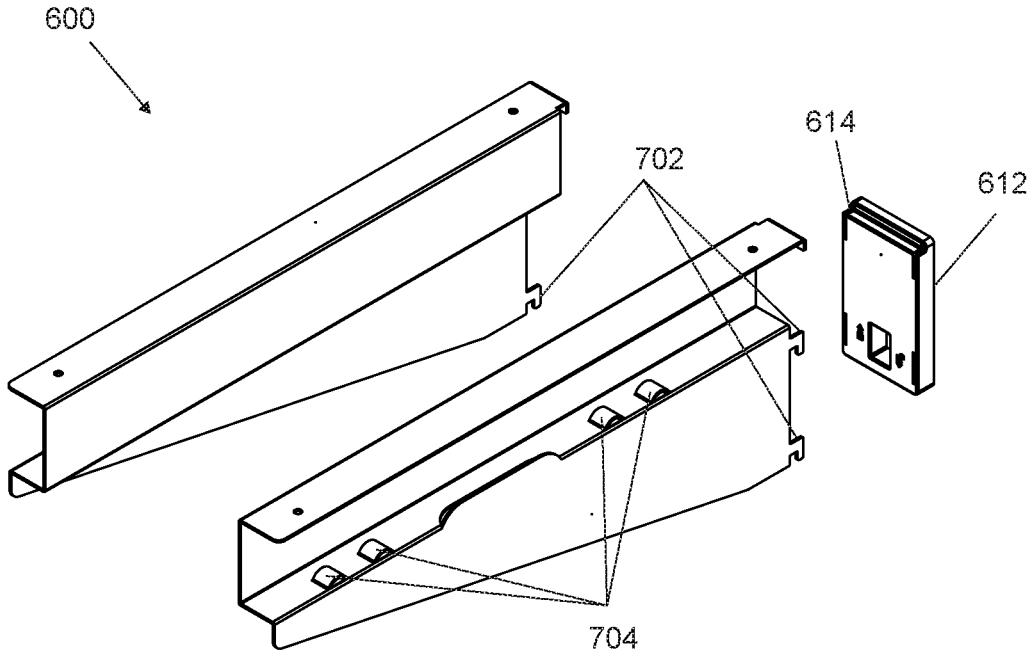
FIG. 7A depicts an exploded view of the bracket in FIG. 6A.
Figure 7B:
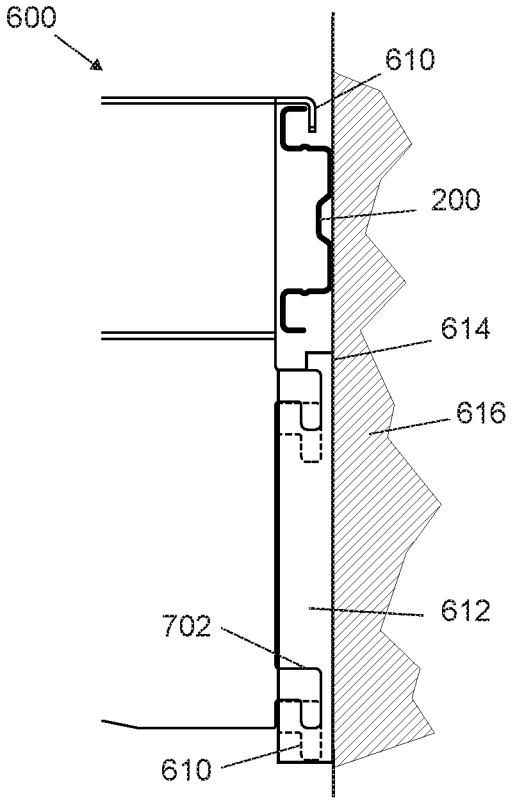
FIGS. 7B-7C depict a track, bracket, and adapter in a slidable relationship.
Figure 7C:
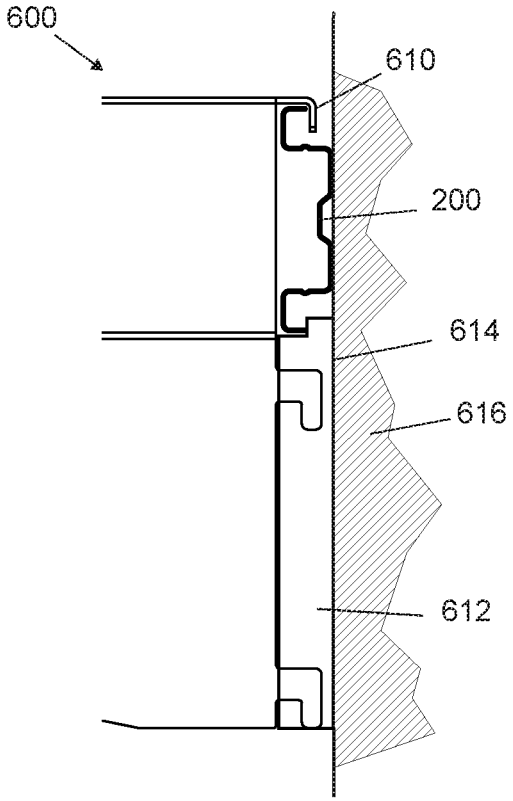
Figure 8A:
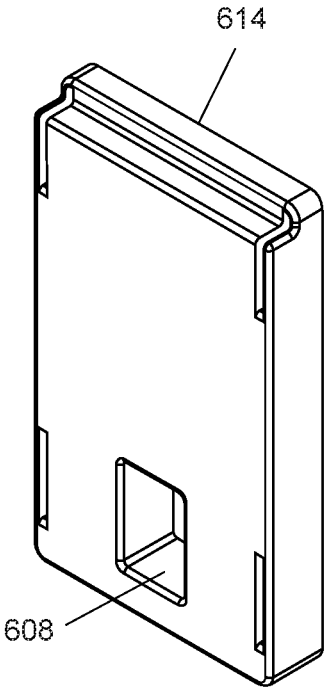
FIGS. 8A-8D depict various views of an adapter that removably couples to the bracket in FIG. 6A.
Figure 8B:
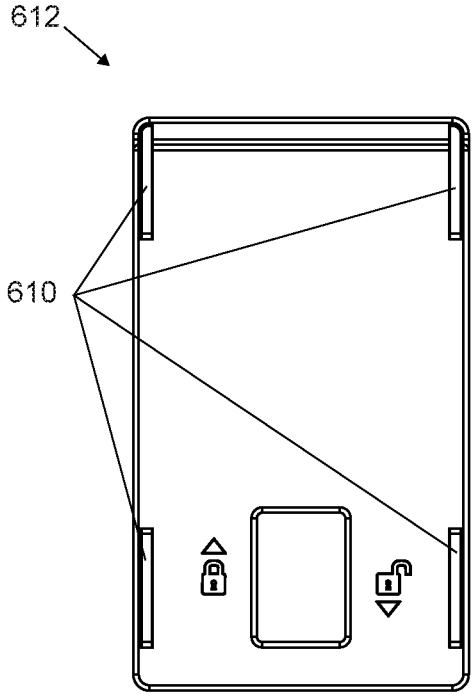
Figure 8C:
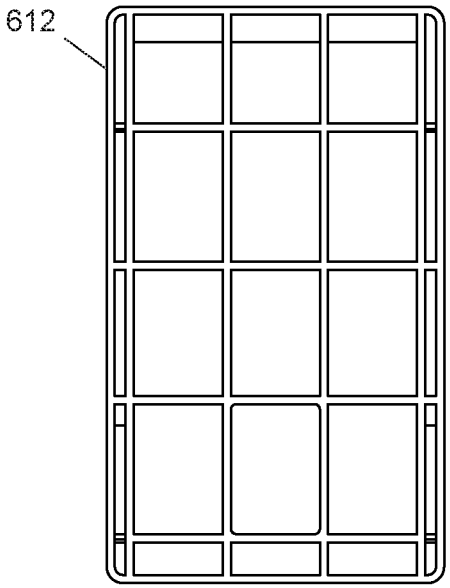
Figure 8D:
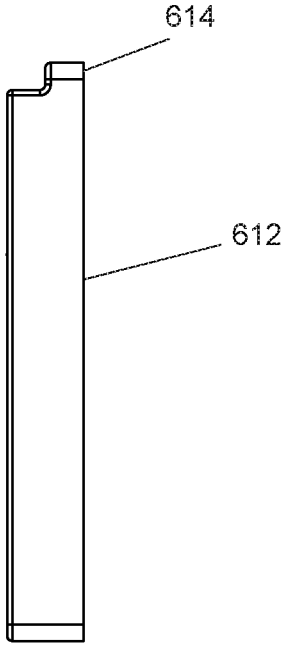

FIG. 7A depicts an exploded view of bracket 600 shown in FIG. 6. As shown, bracket 600 comprises hooks 702 that are configured to engage slots in adapter 612 in a slidable relationship. After hooks of bracket 600 are inserted into slots 406 of adapter 612, it is contemplated that a top hook of bracket 600 can be placed on top of a top rear-facing hook of track 100, and adapter 612 can be slid relative to bracket 600 to thereby position a ridge of adapter 612 at an end of a bottom rear-facing hook of a track to restrict tilting of bracket 600 and further secure bracket 600 on track 100 as shown in FIG. 7B. From the locked configuration, adapter 612 can be slid down to alter the position of the ridge away from the bottom rear-facing hook to allow bracket 600 to tilt for removal from track 100 as shown in FIG. 7B. In alternative embodiments, adapter 612 can engage bracket 600 using a magnetic mechanism, a screw-based mechanism, a friction fit mechanism, and a snap fit mechanism.

FIG. 7A further depicts protrusions 704 located in one or more locations within first and/or second cavities 608. It is contemplated that protrusions 704 releasably mate with corresponding cavities in one or more accessories to secure the accessory to bracket 600.

FIGS. 8A-D depict various views of adapter 612 that removably couples to bracket 600. As depicted, adapter 612 comprises adapter ridge 614 disposed at the top side of adapter 612, a first slot, a second slot, a third slot, and a fourth slot (see slots 610 in FIG. 8B). It is contemplated that adapter 612 further comprises cavity sized and dimensioned to receive a finger of a user to slide adapter 612 relative to bracket 600 between a locked configuration and an unlocked configuration as discussed above. Although adapter ridge 614 of adapter 612 is discussed restricting tilt in a locked configuration when coupled to a track, it is contemplated that adapter ridge 614 can be slid into a second slot of a vertical rail after top hook 610 of bracket 600 is inserted into a first slot of vertical rail 400 to further secure bracket 600 onto vertical rail 400. Additionally, or alternatively, bracket 600 can be mounted onto vertical rail 400 without use of the adapted by inserting at least one hook of bracket 600 into slot 406 of vertical rail 400.

In some embodiments, adapter 612 can be locked in a particular configuration using an engagement member. It is contemplated that an engagement member can comprise any one or more means of causing the adapter to change configurations and/or allow a user to change the configuration of the adapter. For example, changes in configurations can include, but are not limited to, locking and unlocking adapter 612 such that adapter 612 can mounted or dismounted from bracket 600. Some examples of engagement members include, but are not limited to, buttons, sliders, and dials.

In some embodiments, adapter 612 includes both engagement and disengagement members. For example, adapter 612 can have an engagement button and a disengagement button that fixes or releases adapter 612 from bracket 600. Similar to engagement buttons, disengagement buttons can include any mechanisms configured to change the physical configuration of the adapter, such as, for example, buttons, sliders, and dials.

In yet other embodiments, adapter 612 only has a disengagement member. For example, adapter 612 can use a mechanism to automatically lock the adapter into place when adapter 612 is moved into a first position. When adapter 612 is to be removed, a disengagement member can be actuated by a user to unlock adapter 612 from the bracket.

In yet another embodiment, adapter 612 lacks any engagement member and is instead secured through alternative mechanical means. For example, adapter 612 can be fixed onto bracket 600 using a friction fit. In another example, adapter 612 can be fixed onto bracket 600 using an adhesive. In yet another example, adapter 612 can be fixed onto bracket 600 using a screw fastener-based mechanism.

Figure 9A:
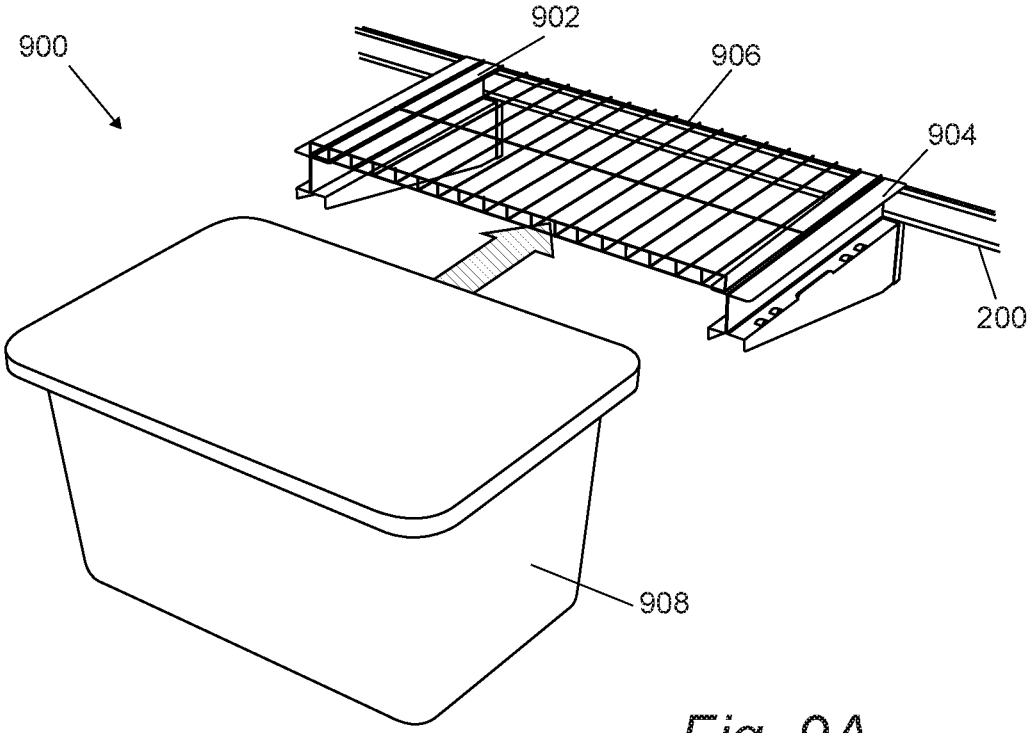
FIGS. 9A-9B depict the bracket in FIG. 6A coupled with the track in FIG. 2 to store containers.
Figure 9B:
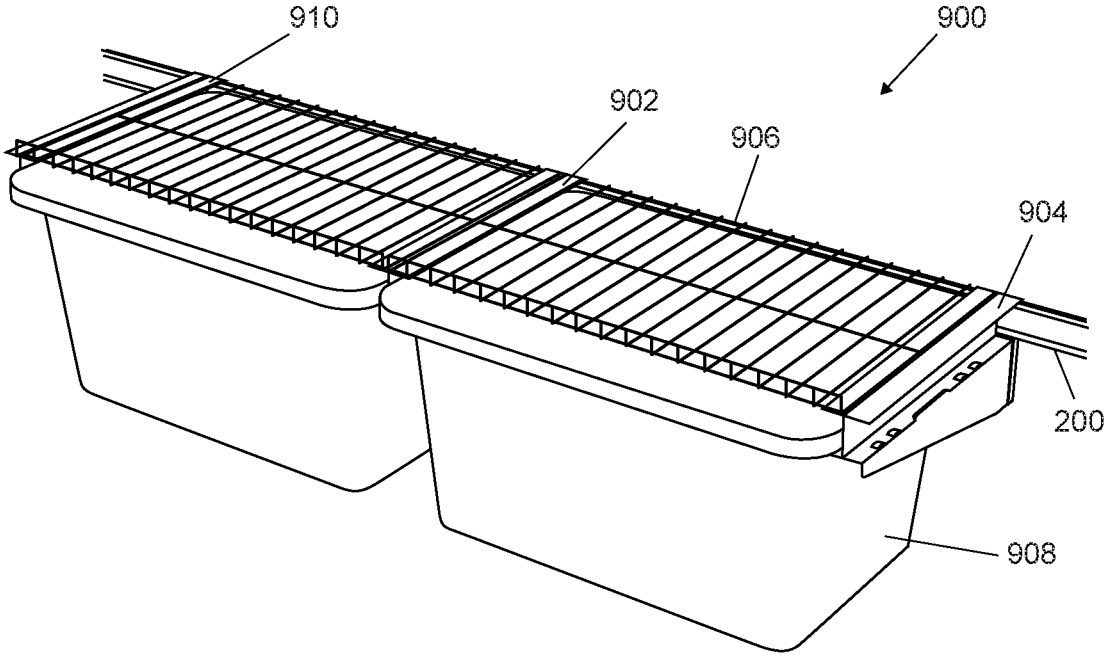

FIGS. 9A-9B depict a bracket and shelf system 900 comprising bracket 902, bracket 904, and a track 200 used cooperatively to store containers 908. As shown in FIG. 9A, first bracket 902 and second bracket 904 are spaced apart such that the handles of container 908 can slide into an accessory rail on first bracket 902 and an accessory rail on second bracket 904. FIG. 9A also depicted a wire shelf 906 that is removable attached to a flat platform 604 on the top side of first bracket 902 and a flat platform 604 on the top side of the second bracket 904.

FIG. 9B shows a third bracket 910 that can be used to mount a second container. It is contemplated that additional bracket and shelf assemblies can be used to mount additional containers. Furthermore, it is contemplated that a container can be placed on top of the shelf.

Figure 10A:
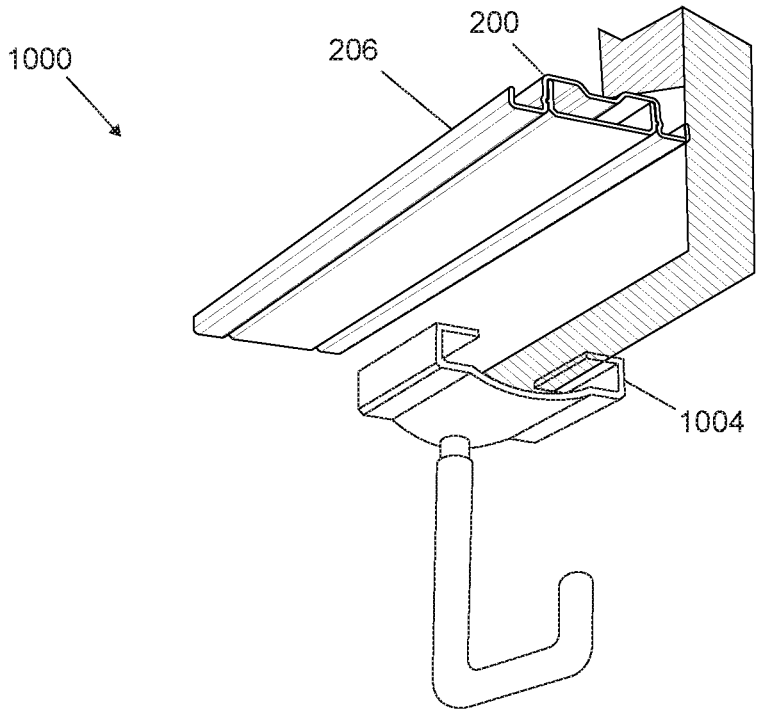
FIGS. 10A-10B depict accessories attached to the track in FIG. 2 on a ceiling for overhead storage.
Figure 10B:
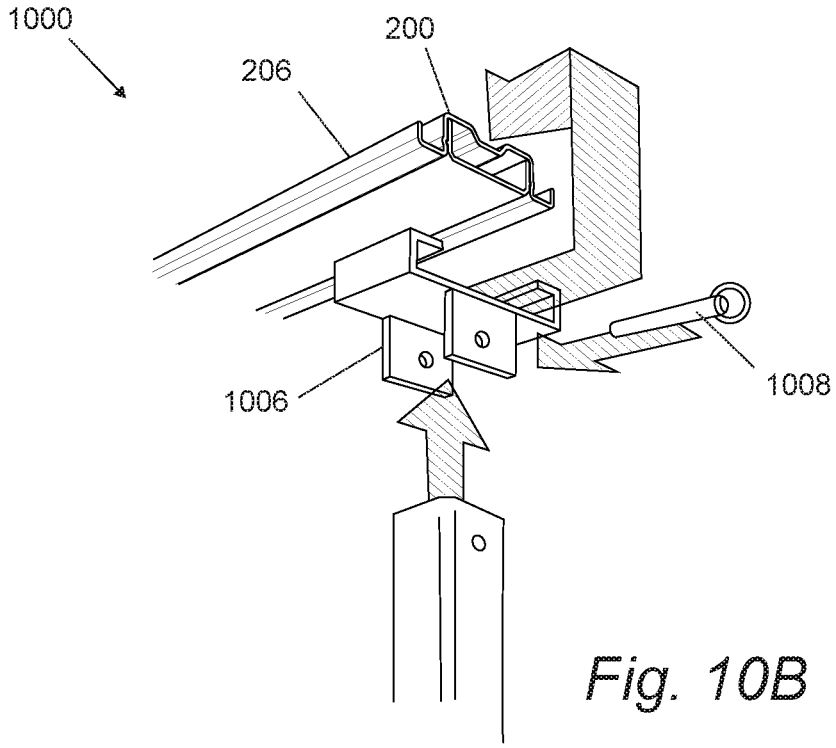

As discussed above, a track can also be mounted onto a ceiling to provide overhead storage. FIGS. 10A-10B depict two accessories that can be attached to track 200 used for overhead storage. FIG. 10A depicts an overhead hook comprising a hook and a coupling unit. Coupling unit 402 comprises a first superior hook and a second superior hook adapted to removably couple to an overhead track. In one embodiment, the overhead hook is removably attached to coupling unit 402. For example, the overhead hook can be coupled using a magnetic coupler, a friction fit coupler, a screw-based coupler, and a snap fit coupler. In another embodiment, the overhead hook can be permanently fixed to coupling unit 402. For example, the overhead hook can be welded to coupling unit 402, where both coupling unit 402 and overhead hook are made of metal. In another example, the overhead hook can be joined to coupling unit 402, where both coupling unit 402 and the overhead hook comprise one or more plastics.

FIG. 10B shows an overhead track system 1000 comprising a coupling unit having hooks 1004 adapted to removably couple to track 200. A locking pin mechanism can be used to couple other items to coupling unit 402. For example, FIG. 11 depicts perspective views of a pin lock 1006 used in an overhead shelf system.

Figure 11A:
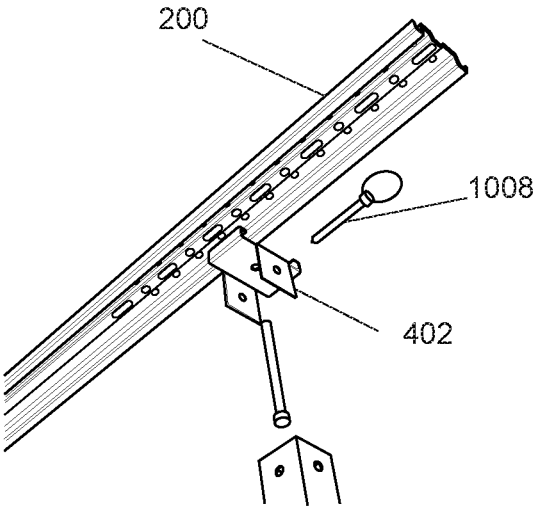
FIGS. 11A-11B depict perspective views of a locking pin mechanism and an overhead shelf system.
Figure 11B:
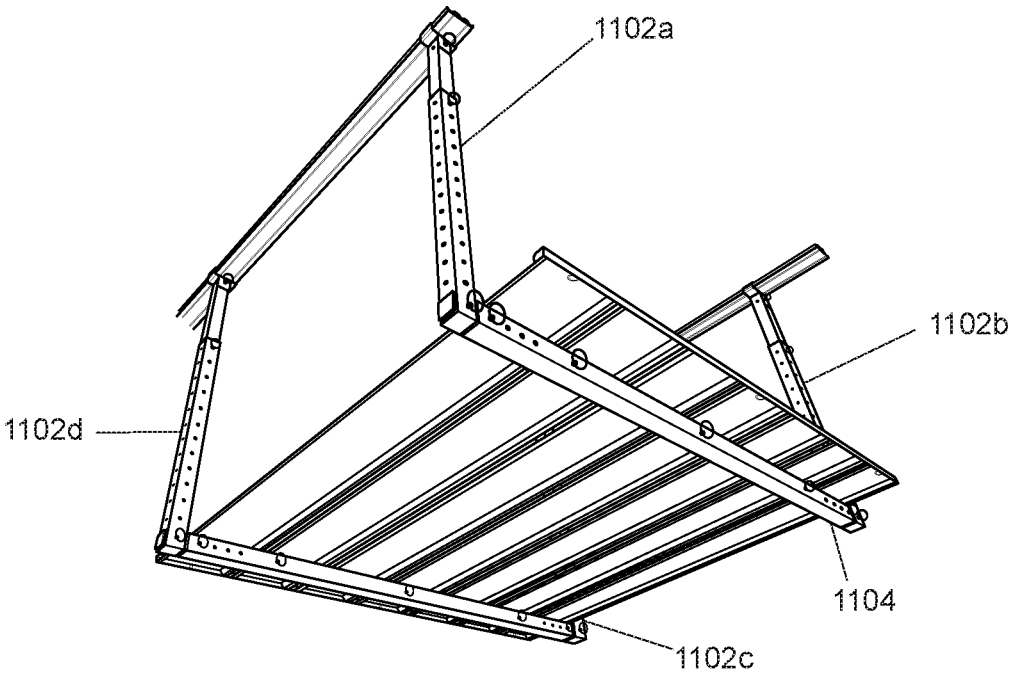

As shown in FIG. 11, track system 200 comprises a first coupling unit, a second coupling unit, a third coupling unit, and a fourth coupling unit (collectively "coupling unit(s) 402") which are coupled on a superior side to an overhead track and coupled on an inferior side to first, second, third, and fourth telescoping arms, respectively (respectively telescoping arms 1102*a-d*). It should be noted that FIG. 11 does not explicitly show the fourth coupling unit and the fourth telescoping arm, but their presence is implied by the perspective view of the overhead shelf system.

Coupling units 402 can be removably attached to telescoping arms 1102. For example, coupling units 402 can be connected to telescoping arms 1102 using a pin lock 1008 as depicted in FIG. 11. Telescoping arms 1102 each comprise a primary arm and a secondary arm in a slidable relationship, such that the primary arm substantially encapsulates the secondary arm when telescoping arm 1102 is in a contracted configuration. In an extended configuration, an inner surface area of the primary arm and an outer surface area of the secondary arm partially overlap. It is contemplated that the primary arm comprises a locking mechanism to restrict the primary and secondary arms from sliding relative to each other. For example, the locking mechanism can comprise a fastener that is inserted into aperture 110 on the primary arm to thereby exert pressure on the secondary arm and provide friction-based restriction of movement. In another example, the locking mechanism can be a detent mechanism which catches corresponding cavities 108 in the primary and/or secondary arms. In yet another example, the locking mechanism can comprise a pin lock mechanism whereby a pin is inserted into aperture 110 of both of the primary and secondary arms.

The bottom-most ends of telescoping arms 1102*a*-1102*d* can be removably coupled to lateral support bars 1104. For example, two lateral support bars 1104 can be removably coupled to the first and third telescoping arms 1102*a* and 1102*c*, and the second and fourth telescoping arms 1102*b* and 1102*d*, respectively. As shown in FIG. 11, a shelf can be placed on top of lateral bars 1104. It is contemplated that the shelf can be attached to the lateral arms using a magnetic coupler, a friction fit coupler, a screw-based coupler, and a snap fit coupler. In alternative embodiments, the shelf can be permanently fixed to the lateral support bars 1104. For example, the shelf and lateral support bars 1104 could be welded together. In yet other embodiments, the shelf and lateral support bars 1104 can be formed as a single piece using a molding process.

Figure 12:
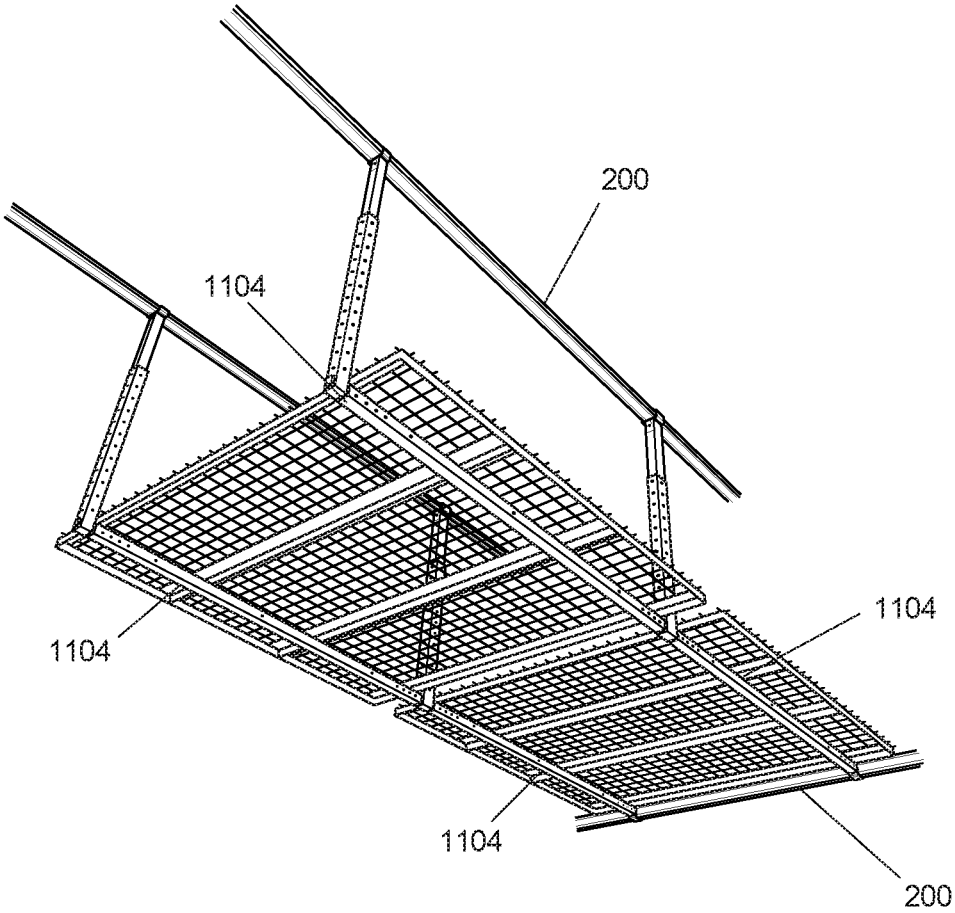
FIG. 12 depicts a perspective view of an overhead storage system coupled to both a track mounted on a ceiling and a track mounted on a vertical wall.

FIG. 12 depicts a perspective view of an overhead storage system 1200 that uses a ceiling track and a vertical wall track. Overhead storage system 1200 comprises four telescoping arms, an overhead track, a support mechanism, and a vertical wall track. As shown in FIG. 12, the four telescoping arms are each connected to the overhead track on one end and a lateral bar on an opposite end. The lateral support bars 1104 support two wire shelf units. Furthermore, two of the lateral support bars 1104 are coupled to the vertical wall track. The lateral support bars 1104 can be coupled to the vertical wall track using a separate coupling mechanism or an internal coupling mechanism to engage the rear facing hooks of the vertical wall track. For example, the lateral support bars 1104 can comprise a hook mechanism that engages hooks 404 of the vertical wall track (e.g., hooks of coupling unit of vertical rail, hooks of coupling unit shown in FIG. 10B). Thus, it is contemplated that the lateral support bars 1104 can couple overhead tracks and/or vertical tracks to provide support for overhead storage.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A track in combination with a structure for mounting devices onto the structure, the track comprising:

a support surface that is directly mounted to the structure, the support surface having a front-facing surface and an opposing rear-facing surface on a rear side of the track, wherein the rear-facing surface of the support surface abuts the structure;

a first rear-facing hook disposed on a top edge of the track that bends toward the rear side of the track;

a second rear-facing hook disposed on a bottom edge of the track that bends toward the rear side of the track;

wherein the first rear-facing hook and the second rear-facing hook are disposed on opposite ends of the support surface; and wherein the top edge and the bottom edge each terminate at a point that is located forward from the front-facing surface of the support surface.

2. The track of claim 1, wherein a first portion of the first rear-facing hook extends from a first end of the support surface to a front side of the track.

3. The track of claim 2, wherein the first portion of the first rear-facing hook comprises a coupling member.

4. The track of claim 2, wherein a first portion of the second rear-facing hook extends from a second end of the support surface to the front side of the track.

5. The track of claim 4, wherein the first portion of the first rear-facing hook and the first portion of the second rear-facing hook each comprise a coupling member.

6. The track of claim 2, wherein a second portion of the first rear-facing hook extends along the front side of the track.

7. The track of claim 6, wherein a third portion of the first rear-facing hook extends from the front side of the track towards the rear side of the track.

8. The track of claim 7, wherein the second portion of the first rear-facing hook extends between the first and third portions of the first rear-facing hook.

9. The track of claim 7, wherein the second and third portions of the first rear-facing hook form an "L"-shape.

10. The track of claim 2, wherein the first portion of the first rear-facing hook and the support surface form an "L"-shape.

11. The track of claim 1, wherein the support surface is flat.

12. The track of claim 1, wherein the support surface comprises a first row of apertures.

13. The track of claim 12, wherein the support surface comprises a second row of apertures.

14. The track of claim 13, wherein the support surface comprises a third row of apertures and slots.

15. A track for mounting devices, comprising:

a support surface that is directly mounted to the structure, the support surface having a front-facing surface and an opposing rear-facing surface;

a top edge of the support surface comprising a first rear-facing hook that bends toward a rear side of the track;

a bottom edge of the support surface comprising a second rear-facing hook that bends toward the rear side of the track;

wherein the top edge and the bottom edge end at locations that are forward from the support surface;

a cover;

a cavity defined by at least a portion of the front-facing surface of the support surface, the first hook and the second hook; and wherein the first rear-facing hook and the second rear-facing hook are disposed on opposite ends of the support surface; and wherein the cavity is sized and dimensioned to receive the cover to thereby hide at least a portion of the cavity when viewed from a front side, wherein, in use, the cover is received on the front-facing surface of the support surface.

16. The track of claim 15, wherein the first hook comprises a first coupling member that is configured to couple with a second coupling member of the cover.

17. The track of claim 16, wherein the second hook comprises a third coupling member that is configured to couple with a fourth coupling member of the cover.

18. The track of claim 15, wherein the support surface comprises apertures, and the cavity is sized and dimensioned to receive the cover and thereby hide the apertures when the track is viewed from the front side.

19. The track of claim 15, wherein the support surface is flat.

* * * * *